US006202973B1

(12) United States Patent
Navarin et al.

(10) Patent No.: US 6,202,973 B1
(45) Date of Patent: Mar. 20, 2001

(54) ADJUSTABLE BOOK HOLDER

(76) Inventors: Rony Navarin; Yves Marthe Georges, both of 789 Walnut Ct., Bensalem, PA (US) 19020

( * ) Notice: Subject to any disclaimer, the term of this patent is extended or adjusted under 35 U.S.C. 154(b) by 0 days.

(21) Appl. No.: 09/413,457

(22) Filed: Oct. 6, 1999

(51) Int. Cl.[7] ..... A47B 97/04

(52) U.S. Cl. ..... 248/444; 248/441.1; 248/448

(58) Field of Search ..... 248/441.1, 444, 248/447, 447.2, 448, 449, 451, 452, 453, 709.1, 339, 340, 354.4, 354.3, 346.01, 346.03, 346.04, 346.06

(56) References Cited

U.S. PATENT DOCUMENTS

| | | | | |
|---|---|---|---|---|
| 2,439,950 | * | 4/1948 | Rogers | 248/447 |
| 2,568,354 | * | 9/1951 | Moore | 248/448 |
| 2,627,694 | * | 2/1953 | Saecker | 248/447 |
| 2,685,757 | * | 8/1954 | Mirigian | 248/444 |
| 3,351,312 | | 11/1967 | Ballas | 248/448 |
| 3,408,032 | * | 10/1968 | Francis | 248/450 |
| 3,497,882 | | 3/1970 | Weeks | 5/332 |
| 4,021,013 | | 5/1977 | Wiersma | 248/453 |
| 4,165,856 | * | 8/1979 | Wiseheart | 248/449 |
| 4,431,156 | * | 2/1984 | Mena | 248/445 |
| 4,448,384 | * | 5/1984 | Jones, Jr. et al. | 248/443 |
| 4,553,728 | * | 11/1985 | Corsello | 248/452 |
| 4,591,124 | | 5/1986 | Hellenbrand et al. | 248/447.2 |
| 4,867,407 | | 9/1989 | Becker | 248/444.1 |
| 6,045,179 | * | 4/2000 | Harrison | 197/188.2 |

* cited by examiner

*Primary Examiner*—Anita M. King
*Assistant Examiner*—Tan Le
(74) *Attorney, Agent, or Firm*—Henderson & Sturm LLP

(57) ABSTRACT

A book support apparatus having a plurality of adjustable features to captively engage books and other articles of different sites. The book support apparatus also includes straps that secure the device to the user's torso.

10 Claims, 2 Drawing Sheets

ADJUSTABLE BOOK HOLDER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of book holders, and more particularly to a fully adjustable book holder.

2. Description of the Related Art

As can be seen by reference to the following U.S. Pat. Nos. 3,497,882; 3,351,312; 4,021,013; 4,591,124; and 4,867,407 the prior art is replete with myriad and diverse support mechanisms attached to beds for holding books or other articles.

While all of the aforementioned prior art constructions are more than adequate for the basic purpose for which they have been specifically designed, they are uniformly deficient with respect to their failure to provide a simple, efficient and practical adjustable book holder.

As a consequence of the foregoing situation, there has existed a need for a new and improved adjustable book holder and the provision of such a construction is a stated objective of the present invention.

BRIEF SUMMARY OF THE INVENTION

Briefly stated, the present invention provides a book support apparatus having a plurality of adjustable features to captively engage books and other articles of different sites. The book support apparatus also includes straps that secure the device to the user's torso.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
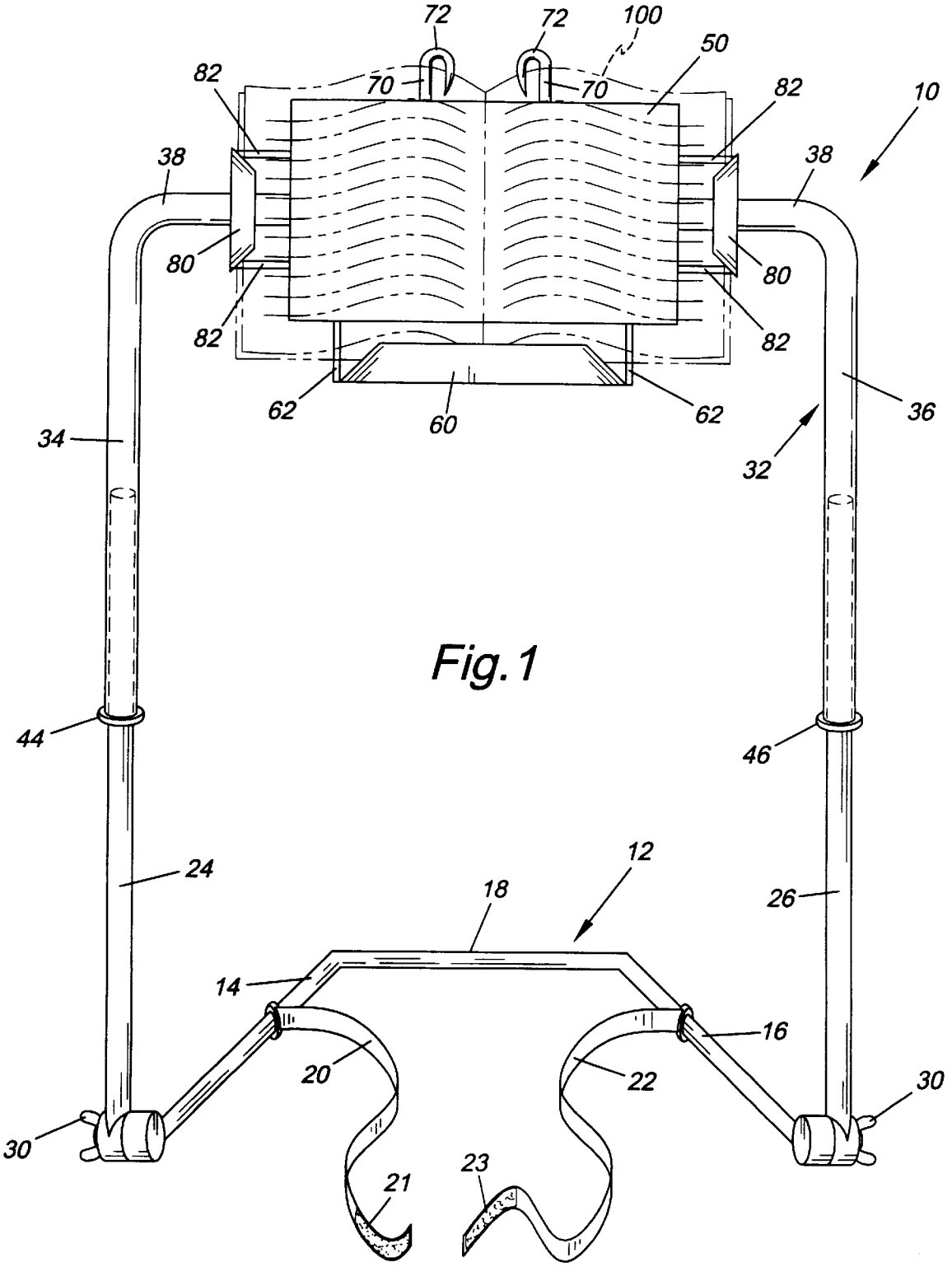
FIG. 1 is a front perspective view of the book holder of the present invention.

As can be seen by reference to the drawings, and in particulary to FIG. 1, the adjustable book holder that forms the basis of the present invention is designated generally by reference number (10). The book holder (10) includes a horizontally disposed rectangular base (12) formed of a pair of side members (14), (16) interconnected by a transverse member (18). A pair of straps (20), (22) are attached to their respective side members (14), (16) and include free ends which carry complementary hook and loop fasteners (21), (23).

Figure 4:
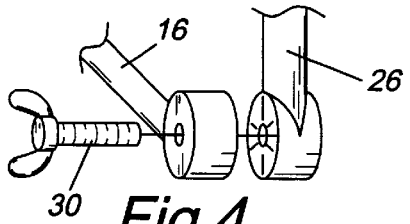
FIG. 4 is a partial front perspective view of the adjusting and locking mechanism connecting the side member of the base and the upwardly extending leg.
Figure 5:
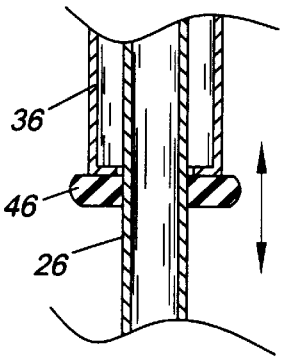
FIG. 5 is an enlarged sectional view showing the telescopic connection of the leg and the tube of the frame with an adjustable stop frictionally engaging the leg.

A pair of upwardly extending legs (24), (26) are movably and lockably attached to their respective side members (14), (16) by wing bolts (30) as shown in FIG. 4. A frame (32), including side tubes (34), (36) and interconnecting top bar (38), is telescopically attached to the base (12) by engagement of the respective ends of legs (24), (26) and tubes (34), (36). The elevation of the top bar (38) with respect to the base (12) is selectively adjusted by the positioning of stops (44), (46) on the respective legs (24), (26). The stops (44), (46) frictional engage the legs (24), (26) and the lower end of tubes (34), (36) contact and rest on stops (44), (46) as illustrated in FIG. 5.

Figure 2:
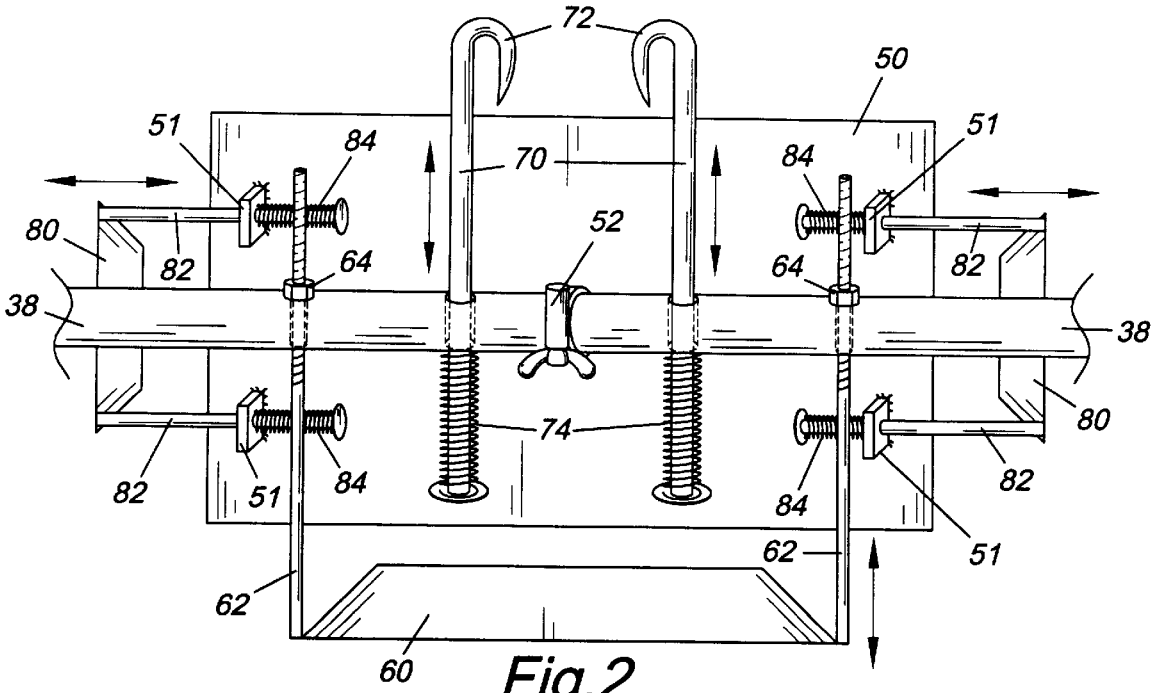
FIG. 2 is a partial rear elevational view of the planar book support.
Figure 3:
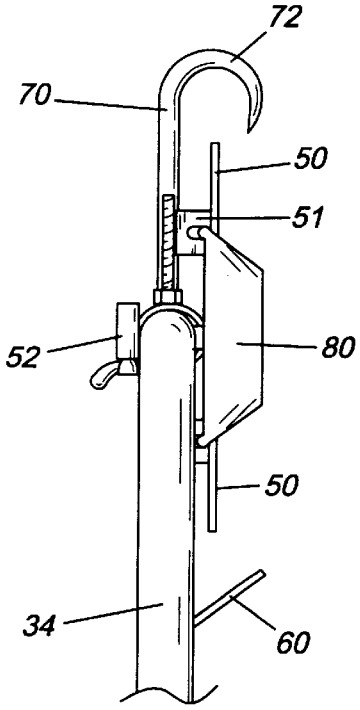
FIG. 3 is a partial side elevational view of the book support.

A planar book support (50) is attached to the frame (32) by engagement of an adjustable clamp (52) with the top bar (38). A bottom support ledge (60) is adjustably attached to the top bar (38) by threaded rods (62). The position of the ledge (60) with respect to the book support (50) is adjusted by adjusting the position of nuts (64) on the rods (62) as illustrated in FIG. 2.

A pair of top retainers (70) having upper hooked ends (72) are adjustably attached to the top bar (38) and are downwardly biased by springs (74). A pair of side retainers (80) are adjustably attached to the rear surface of the book support (50) by rods (82) that extend through tabs (51). The tabs (51) are attached to the back of the book support (50) and act as a retainer for the springs (84) that bias the side retainers (80) inwardly.

In use the book holder (10) is placed on the user's stomach and the straps (21), (22) are secured around the torso. A book (100) is placed on the bottom ledge (60) with the hooked ends (72) of the top retainers (70) positioned over the top of the pages of the book (100) and the side retainers (80) positioned over the edges of the pages of the book (100). The angle and elevation of the frame (32) with respect to the base (12) is adjusted by wing bolts (30) and positioning of the stops (46), the angle of the book support (50) with respect to the frame is adjusted by operation of the clamp (52), and the position of the bottom ledge (60) is adjusted by the nuts (64).

The book holder (10) allows the user to read while reclined on a bed, couch or chair without the need to constantly hold the book with their hands. The multiple adjustments available allow convenient, flexible use in a variety of reclined positions.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. An adjustable book holder, comprising:

a horizontally disposed base including a pair of spaced side members, each side member having a first end and a second end, the first ends being interconnected by a transverse member;

a pair of spaced legs, each including a lower end and an upper end, the lower end being movably and lockably attached to a respective one of the side members at its second end and disposed to extend upwardly therefrom.

a frame having a pair of spaced tubes and an interconnecting upper bar, the tubes being aligned with and disposed to telescopically engage the upper end of the legs;

an adjustable stop movably attached in frictional engagement with each of the legs, each stop being disposed to contact a respective tube when it telescopically engages the leg;

a planar book support having a front surface, a rear surface, a top edge, a bottom edge, and lateral edges;

an adjustable clamp, the clamp being rigidly attached to the rear surface of the book support and movably and lockably attached to the upper bar of the frame;

a bottom support ledge adjustably attached to the upper bar of the frame by a pair of spaced threaded rods and disposed to extend below the bottom edge of the book support;

a pair of spaced adjustable top retainers attached to the upper bar of the frame, each top retainer having an upper hooked end disposed to extend below the bottom edge of the book support; and above the top edge of the book support a pair of spaced, adjustable top retainers attached to the upper bar of the frame, each top retainer having an upper hooked end disposed to extend above the top edge of the book support, each side retainer disposed to extent out from a respective lateral edge of the book support and being biased inwardly.

2. The book holder of claim 1 further including a pair of straps, each strap being attached to a respective side member at the base and including a free end carrying a connector.

3. The book holder of claim 2 wherein the connectors of the straps are complementary hook and loop fasteners.

4. The book holder of claim 1 wherein the top retainers are spring biased.

5. The book holder of claim 2 wherein the top retainers are spring biased.

6. The book holder of claim 3 wherein the top retainers are spring biased.

7. The book holder of claim 1 wherein the side retainers are spring biased.

8. The book holder of claim 2 wherein the side retainers are spring biased.

9. The book holder of claim 3 wherein the side retainers are spring biased.

10. The book holder of claim 4 wherein the side retainers are spring biased.

* * * * *